US007831371B2

(12) United States Patent
Nishimura et al.

(10) Patent No.: US 7,831,371 B2
(45) Date of Patent: Nov. 9, 2010

(54) CONTROL APPARATUS FOR AN INTERNAL COMBUSTION ENGINE

(75) Inventors: Hideki Nishimura, Chiyoda-ku (JP); Eiji Kanazawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 70 days.

(21) Appl. No.: 12/264,486

(22) Filed: Nov. 4, 2008

(65) Prior Publication Data

US 2009/0292452 A1 Nov. 26, 2009

(30) Foreign Application Priority Data

May 20, 2008 (JP) ..... 2008-132095

(51) Int. Cl.
*F02D 9/08* (2006.01)
*F02D 9/10* (2006.01)

(52) U.S. Cl. ..... 701/103; 123/403

(58) Field of Classification Search ..... 701/103, 701/102, 101; 123/399, 436, 674, 402, 403, 123/480

See application file for complete search history.

(56) References Cited

U.S. PATENT DOCUMENTS 7,305,967 B1 * 12/2007 Hagari et al. ..... 123/403

FOREIGN PATENT DOCUMENTS

| | | | |
|---|---|---|---|
| DE | 102006043887 | * | 9/2007 |
| JP | 2006-138270 | A | 6/2006 |
| JP | 2007-239650 | A | 9/2007 |
| JP | 2008-057339 | A | 3/2008 |

* cited by examiner

*Primary Examiner*—Mahmoud Gimie
(74) *Attorney, Agent, or Firm*—Sughrue Mion, PLLC

(57) ABSTRACT

The control apparatus for an internal combustion engine includes a throttle opening learning value calculation unit for calculating a throttle opening learning value based on a deviation between a target throttle opening and a learning throttle opening, controls the throttle opening by a learning corrected target throttle opening obtained by correcting the target throttle opening with the throttle opening learning value, and updates and stores a real-time learning value and a long time learning value based on a magnitude relation between values respectively obtained by adding the long time learning value to throttle openings respectively indicated by two effective opening area axis points of a correlation map, between which lies an actual effective opening area, and an actual throttle opening when the throttle opening learning value composed of the real-time learning value and the long time learning value is to be calculated.

6 Claims, 9 Drawing Sheets

CONTROL APPARATUS FOR AN INTERNAL COMBUSTION ENGINE

BACKGROUND OF THE INVENTION

1. Field of the Invention

The present invention relates to a control apparatus for an internal combustion engine, capable of controlling a throttle opening to obtain a target amount of intake air.

2. Description of the Related Art

Recently, there has been proposed a control apparatus for an internal combustion engine using an output shaft torque of an internal combustion engine (engine), which corresponds to a physical quantity directly acting on the control of a vehicle, as a requested value of a driving force from a driver or a vehicle side. In such a control apparatus for an internal combustion engine, good running performance is obtained by deciding the amount of air, the amount of fuel, and ignition timing corresponding to engine control quantities by using the output shaft torque as an output target value of the engine.

In addition, it is generally known that a control quantity which has the greatest influence on the engine output shaft torque among the engine control quantities is the amount of air. Therefore, for controlling the amount of air with high accuracy, the applicant of the present application has proposed a control apparatus for an internal combustion engine for calculating a target effective opening area of an intake system based on a target flow rate of intake air, an atmospheric pressure, an intake manifold pressure, and an intake air temperature and for outputting a target throttle opening from a correlation map which prestores a correlation between an effective opening area of the intake system and an opening of a throttle valve to control the throttle opening (for example, see Japanese Patent Application Laid-open No. 2007-239650; hereinafter, referred to as Patent Document 1).

However, in Patent Document 1, even at the same throttle opening, a variation is generated in an actual opening area or flow coefficient due to a manufacturing variation for each individual throttle body. Therefore, the flow rate of intake air varies for each throttle body. Moreover, a variation is also generated in the calculated opening area or effective opening area due to a variation between sensors for measuring the intake manifold pressure, the atmospheric pressure or the intake air temperature, or an error inherent in an estimation method.

As described above, there is a problem in that a variation is generated in the actual flow rate of intake air with respect to the target flow rate of intake air due to the variations between the throttle bodies, various sensors, and the like, or various estimation errors.

Therefore, in order to solve the above problem, the applicant of the present application has proposed throttle opening learning means for learning and correcting the relation between the effective opening area and the throttle opening to adequately achieve the target flow rate of intake air against the variation between the throttle bodies, various sensors, and the like or various estimation errors when the throttle opening for obtaining the target flow rate of intake air is to be calculated. The applicant of the present application has also proposed a method of storing a throttle learning value (for example, Japanese Patent Application Laid-Open No. 2008-057339; hereinafter, referred to as Patent Document 2).

According to Patent Document 2, a throttle learning value according to a ratio of distances between axis points before and after a target effective opening area and an actual effective opening area is added in at least one of a learning region corresponding to two axis points before and after the target effective opening area and a learning region corresponding to two axis points before and after the actual effective opening area on a correlation map for converting the effective opening area into the throttle opening. Then, the throttle learning value is stored.

FIG. 9 is an explanatory view of the throttle learning value calculated in Patent Document 2 which is the related art. As shown in FIG. 9, the relation of the throttle opening with respect to the actual effective opening area and a set correlation map deviate from each other in a crossing manner. The case where learning is performed in a learning region corresponding to two axis points before and after the actual effective opening area is now considered. In this case, the learning is performed in the same direction according to a ratio of the actual effective opening area to the axis point at the two axis points before and after the actual effective opening area. Therefore, when the learning is performed to cause one axis to get closer to the actual relation, the other axis consequently performs mislearning in the direction opposite to that of the actual relation.

As a result, appropriate learning and mislearning are repeated to greatly fluctuate the stored throttle learning value. Thus, there arises a problem that a deviation is generated in the throttle opening for obtaining the target amount of intake air, which prevents the target amount of intake air from being achieved.

SUMMARY OF THE INVENTION

The present invention is devised to solve the above problem, and has an object of providing a control apparatus for an internal combustion engine, capable of controlling a throttle opening to precisely make the amount of intake air coincide with a target amount of intake air even when there are variations between throttle bodies, various sensors, and the like, or various estimation errors.

A control apparatus for an internal combustion engine according to the present invention includes: a throttle valve that is arranged in an intake passage of the internal combustion engine; throttle opening control means for controlling a throttle opening of the throttle valve to change an effective opening area of the intake passage to variably control an amount of intake air to the internal combustion engine; means for detecting an actual throttle opening of the throttle valve; operating state detection means for detecting an operating state of the internal combustion engine, the operating state detection means including intake air amount detection means for detecting the amount of intake air to the internal combustion engine, atmospheric pressure detection means for detecting a pressure at an atmospheric side of the throttle valve as an atmospheric pressure, intake pipe internal pressure detection means for detecting a pressure at an internal combustion engine side of the throttle valve as an intake pipe internal pressure, and intake air temperature detection means for detecting an intake air temperature at the atmospheric side of the throttle valve; target intake air amount calculation means for calculating a target amount of intake air based on the operating state of the internal combustion engine; target effective opening area calculation means for applying the target amount of intake air, the atmospheric pressure, the intake pipe internal pressure, and the intake air temperature to a flow rate formula for a throttle type flow meter to calculate a target effective opening area of the throttle opening control means; target throttle opening calculation means for using a correlation map between the effective opening area of the throttle opening control means and the throttle opening of the throttle opening control means, which are suited to each other in advance, to calculate a target throttle opening from the target effective opening area; actual effective opening area calculation means for applying the amount of intake air, the atmospheric pressure, the intake pipe internal pressure, and the intake air temperature to the flow rate formula for the throttle type flow meter to calculate an actual effective opening area of the throttle opening control means; and learning throttle opening calculation means for using the correlation map to calculate a learning throttle opening from the actual effective opening area. The throttle opening control means includes throttle opening learning value calculation means for calculating a throttle opening learning value based on a deviation between one of the actual throttle opening and the target throttle opening, and the learning throttle opening, and controls the throttle opening by a learning corrected target throttle opening obtained by correcting the target throttle opening with the throttle opening learning value, and the throttle opening learning value calculation means calculates the throttle opening learning value as a value composed of a real-time learning value updated in real time and a long time learning value corresponding to each learning region according to an effective opening area axis point of the correlation map, and updates and stores the real-time learning value and the long time learning value based on a magnitude relation between values respectively obtained by adding the long time learning value to throttle openings respectively indicated by two effective opening area axis points of the correlation map, between which lies the actual effective opening area, and the actual throttle opening when the throttle opening learning value is to be calculated.

According to the control apparatus for an internal combustion engine of the present invention, the relation between the effective opening area and the throttle opening is learned and corrected to achieve a good target amount of intake air, and a learning value thereof is appropriately stored. As a result, the control apparatus for an internal combustion engine, capable of controlling the throttle opening to precisely make the amount of intake air coincide with the target amount of intake air, can be obtained even when there are variations between the throttle bodies, various sensors, and the like, or various estimation errors.

DETAILED DESCRIPTION OF THE PREFERRED EMBODIMENT

Hereinafter, a preferred embodiment of a control apparatus for an internal combustion engine of the present invention is described referring to the accompanying drawings.

First Embodiment

Figure 1:
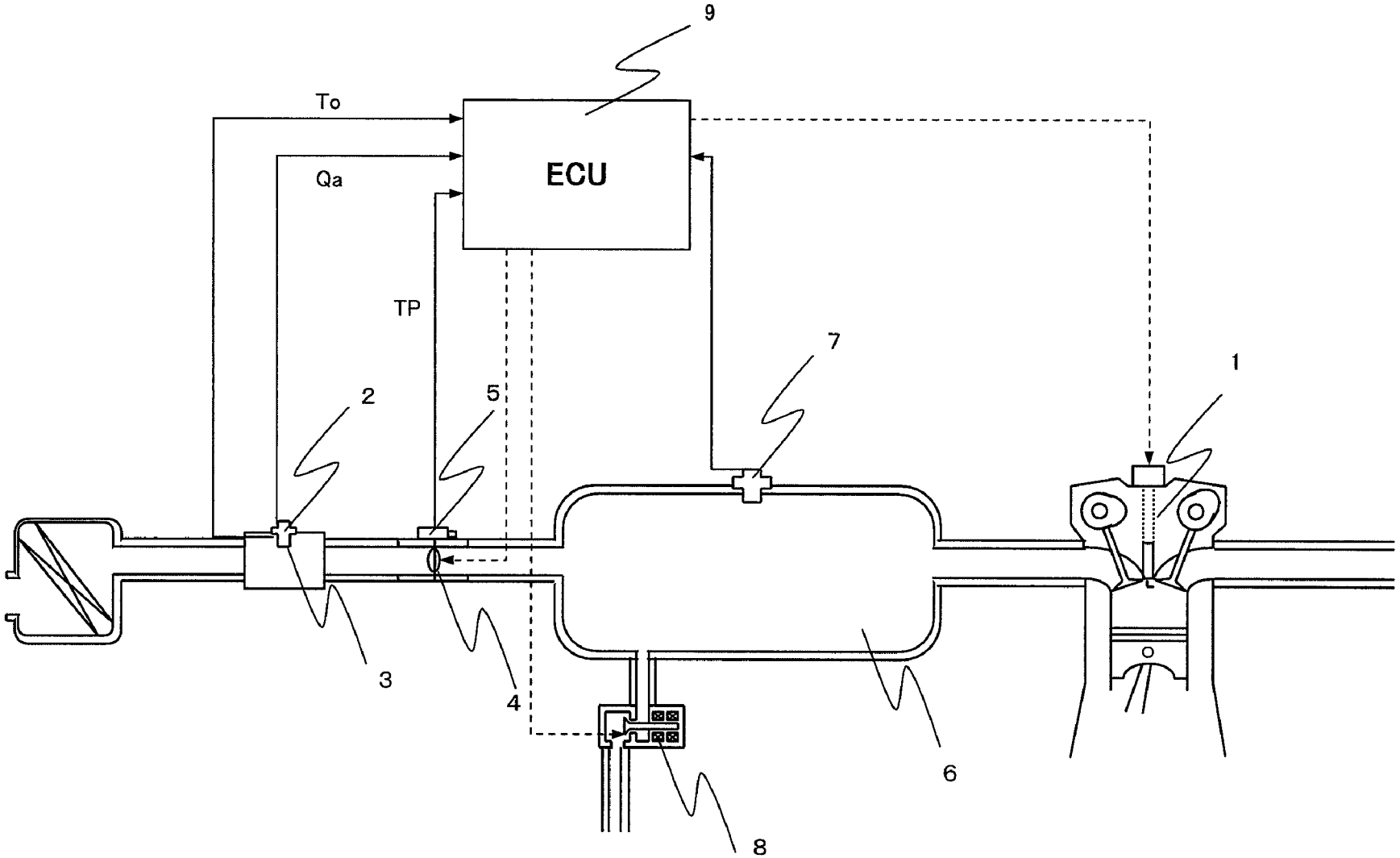
FIG. 1 is a configuration diagram schematically illustrating a control apparatus for an internal combustion engine in a first embodiment of the present invention.
Figure 2:
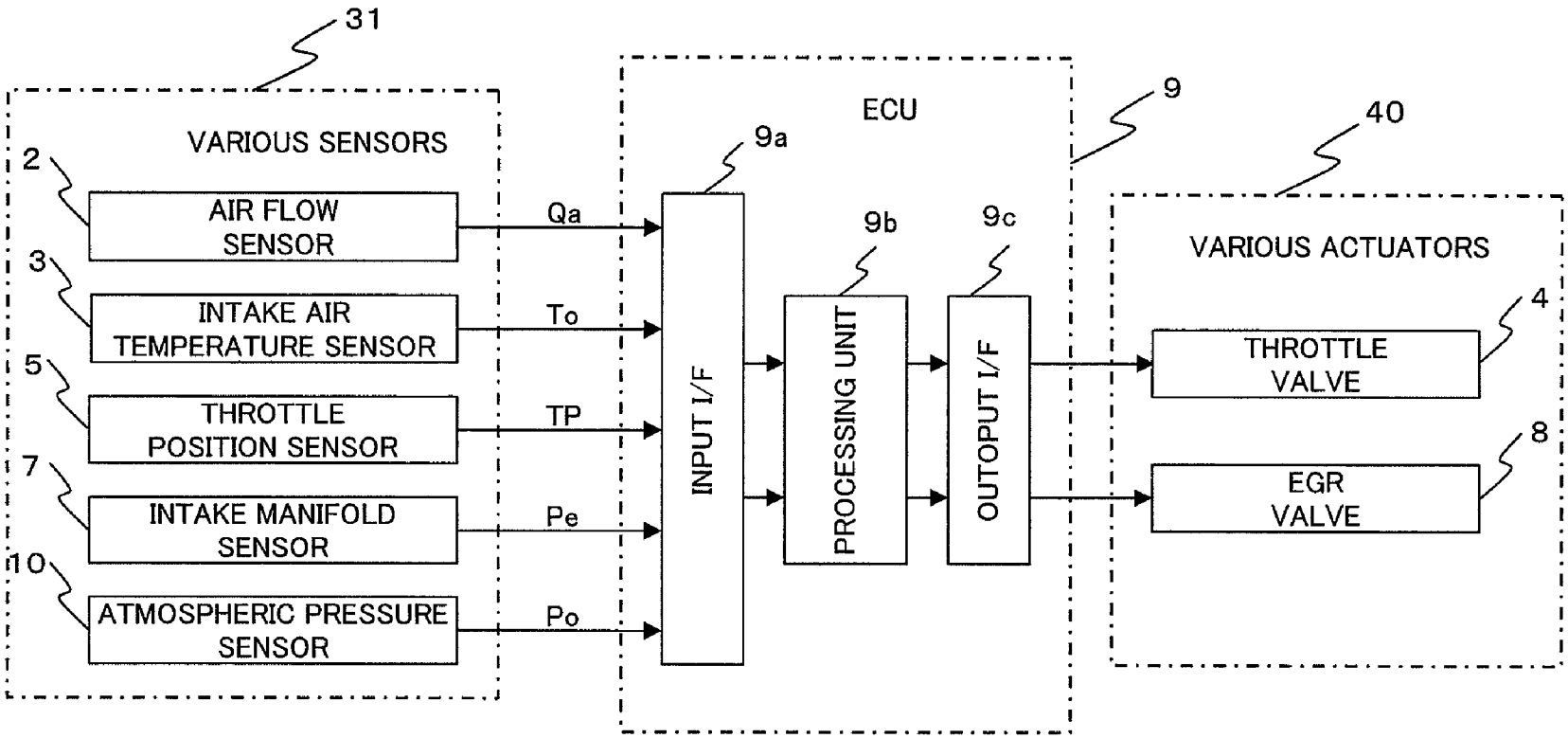
FIG. 2 is a block diagram illustrating a schematic configuration of an engine control section of the control apparatus for an internal combustion engine in the first embodiment of the present invention.

FIG. 1 is a configuration diagram schematically illustrating a control apparatus for an internal combustion engine in a first embodiment of the present invention. The control apparatus for an internal combustion engine in this first embodiment includes an engine 1, an air flow sensor 2, an intake air temperature sensor 3, a throttle valve 4, a throttle position sensor 5, a surge tank 6, an intake manifold pressure sensor 7, an EGR valve 8, and an electronic control unit 9 (hereinafter, referred to as "ECU 9"). FIG. 2 is a block diagram illustrating a schematic configuration of an engine control section of the control apparatus for an internal combustion engine in the first embodiment of the present invention, and schematically illustrates a peripheral configuration of the ECU 9.

In FIG. 1, at an upstream side of an intake passage that constitutes an intake system of the engine 1, there are arranged the air flow sensor 2 that measures the flow rate of intake air (hereinafter, referred to as "amount of intake air") Qa sucked to the engine 1, and the intake air temperature sensor 3 that measures the temperature of intake air (hereinafter, referred to as "intake air temperature") To.

Here, note that the intake air temperature sensor 3 may be formed integrally with the air flow sensor 2, or may be formed separately from the air flow sensor 2. In addition, means for calculating an estimate of the intake air temperature To from other sensor information may be used in place of the intake air temperature sensor 3 that directly measures the intake air temperature To.

In the intake system of the engine 1, at the engine 1 side downstream of the air flow sensor 2, there is arranged the throttle valve 4 that is controlled to open and close for adjusting the amount of intake air Qa. The throttle position sensor 5 for measuring the actual opening degree TP is attached to the throttle valve 4.

Also, at the engine 1 side downstream of the throttle valve 4, there are arranged the surge tank 6 that serves to make uniform the pressure in an intake pipe, and the intake manifold pressure sensor 7 that measures the pressure in the surge tank 6 as an intake pipe internal pressure (intake manifold pressure) Pe. Further, connected to the surge tank 6 is the EGR valve 8 that serves to open and close an EGR tube which is placed in communication with an exhaust pipe of the engine 1. Here, note that in place of the intake manifold pressure sensor 7 that directly measures the intake manifold pressure Pe, there may be used means for calculating an estimate of the intake manifold pressure Pe from other sensor information.

The amount of intake air Qa from the air flow sensor 2, the intake air temperature To (temperature at an atmospheric side of the throttle valve 4) from the intake air temperature sensor 3, the actual throttle opening TP from the throttle position sensor 5, and the intake manifold pressure Pe from the intake manifold pressure sensor 7 are input to the ECU 9 as information indicating the operating state of the engine 1 together with detection signals from other sensors (not shown).

The ECU 9 controls the actual throttle opening TP of the throttle valve 4 in accordance with the result of calculation based on the operating state to thereby adjust the amount of intake air Qa. The ECU 9 also controls and drives a fuel injection system and an ignition system (not shown) of the engine 1 at required timing, and to open and close the EGR valve 8 to thereby improve the combustion state of the engine 1.

In FIG. 2, connected to the ECU 9 are various kinds of sensors 30 which includes, in addition to the above-mentioned group of sensors (air flow sensor 2, intake air temperature sensor 3, throttle position sensor 5, and intake manifold pressure sensor 7), an atmospheric pressure sensor 10, etc., that detect the pressure at an atmospheric side of the throttle valve 4 as an atmospheric pressure Po.

The ECU 9 is provided with an input interface 9*a* (hereinafter, referred to as "input I/F 9*a*"), a processing unit 9*b*, and an output interface 9*c* (hereinafter, referred to as "output I/F 9*c*").

The input I/F 9*a* takes in the detected information from the above-mentioned group of sensors (air flow sensor 2, air temperature sensor 3, throttle position sensor 5, intake manifold pressure sensor 7), the atmospheric pressure Po measured by the atmospheric pressure sensor 10, and detection signals from the other sensors that are included in the various kinds of sensors 30, and inputs the taken-in signals to the processing unit 9*b*. Here, note that in place of the atmospheric pressure sensor 10 that directly measures the atmospheric pressure Po, there may be used means for calculating an estimate of the atmospheric pressure Po from other sensor information.

The processing unit 9*b* in the ECU 9 includes throttle opening control means which variably controls the amount of intake air Qa to be supplied to the engine 1 by controlling the actual throttle opening TP of the throttle valve 4 to change the effective opening area of the intake passage. As a result, first of all, the processing unit 9*b* calculates a target torque of the engine 1 based on the input various data (operating state), and then calculates a target amount of intake air Qa* to achieve the target torque thus calculated.

Subsequently, the processing unit 9*b* calculates a target effective opening area CAt* to achieve the target amount of intake air Qa*, and also calculates a target throttle opening TP* (hereinafter, referred to as "target opening TP*") to achieve the target effective opening area CAt*.

Further, the processing unit 9*b* calculates a control command value for the EGR valve 8, and also calculates control command values for other actuators (for example, injectors of the fuel injection system arranged in combustion chambers of the engine 1, ignition coils of the ignition system, etc.) that are included in various kinds of actuators 40.

Finally, the output I/F 9*c* in the ECU 9 outputs driving control signals based on the calculation results of the ECU 9 to the various kinds of actuators 40 including the throttle valve 4 and the EGR valve 8. As a result, the throttle valve 4 is controlled in such a manner that the actual throttle opening TP is made to coincide with the target opening TP*.

Next, calculation processing executed by the processing unit 9*b* in the ECU 9 including the throttle opening control means, that is, processing of calculating the target opening TP* for achieving the target amount of intake air Qa* is described.

Figure 3:
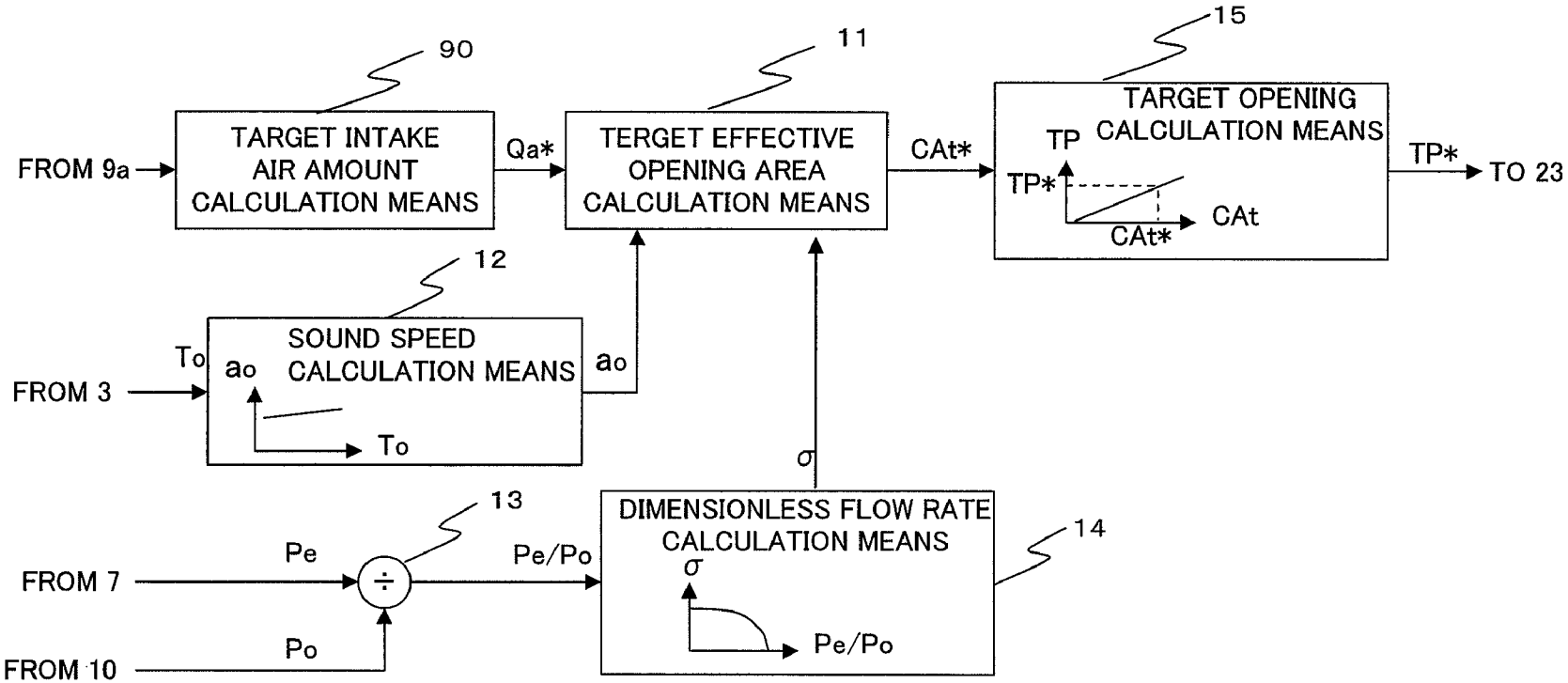
FIG. 3 is a functional block diagram illustrating a configuration of a processing unit in the first embodiment of the present invention.

FIG. 3 is a functional block diagram illustrating a configuration of the processing unit 9*b* in the first embodiment of the present invention. In FIG. 3, the processing unit 9*b* in the ECU 9 is provided with target intake air amount calculation means 90, target effective opening area calculation means 11, sound speed calculation means 12, pressure ratio calculation means 13, dimensionless flow rate calculation means 14, and target opening calculation means 15.

The target intake air amount calculation means 90 calculates the target amount of intake air Qa* to achieve the target torque corresponding to the operating state of the engine 1, and inputs the calculated value of the target amount of intake air Qa* to the target effective opening area calculation means 11. The sound speed calculation means 12 calculates the speed of sound $a_0$ in the atmosphere on the basis of the intake air temperature To, and inputs the calculated value of the speed of sound $a_0$ to the target effective opening area calculation means 11.

The pressure ratio calculation means 13 is in the form of a divider that calculates a pressure ratio Pe/Po of the intake manifold pressure Pe to the atmospheric pressure Po, and inputs the calculated value of the pressure ratio Pe/Po to the dimensionless flow calculation means 14. The dimensionless flow rate calculation means 14 calculates a dimensionless flow rate σ on the basis of the pressure ratio Pe/Po, and inputs the calculated value of the dimensionless flow rate σ to the target effective opening area calculation means 11.

The target effective opening area calculation means 11 calculates the target effective opening area CAt* of the throttle valve 4 based on the target amount of intake air Qa*, the speed of sound $a_0$, and the dimensionless flow rate σ as input information, and inputs the calculated value of the target effective opening area CAt* to the target opening calculation means 15.

The target opening calculation means 15 calculates the target opening TP* corresponding to the target effective opening area CAt* by using a correlation map between the effective opening area CAt and the actual throttle opening TP that are suited to each other in advance ("CAt-TP map" to be described later). The calculated value of the target opening TP* is input to learning corrected target throttle opening calculation means 23 (to be described later).

Next, description is made of the specific calculation processing functions of the individual calculation means 11 to 15 in FIG. 3. In general, a volumetric flow formula for a throttle type flow meter is represented by the following Expression (1) by using the amount of intake air Qa (volumetric flow), the speed of sound $a_0$ in the atmosphere, the flow coefficient C, the opening area At of the throttle valve 4, the intake manifold pressure Pe, the atmospheric pressure Po, and the ratio of specific heats k.

$$Qa = a_0 \cdot CA_t \cdot \sqrt{\frac{2}{\kappa - 1}\left[\left(\frac{P_e}{P_0}\right)^{\frac{2}{\kappa}} - \left(\frac{P_e}{P_0}\right)^{\frac{\kappa+1}{\kappa}}\right]} \tag{1}$$

Here, the dimensionless flow rate σ calculated by the dimensionless flow rate calculation means 14 is defined as shown by the following Expression (2).

$$\sigma = \sqrt{\frac{2}{\kappa - 1}\left[\left(\frac{P_e}{P_0}\right)^{\frac{2}{\kappa}} - \left(\frac{P_e}{P_0}\right)^{\frac{\kappa+1}{\kappa}}\right]} \quad (2)$$

The amount of intake air Qa can be represented by the following Expression (3) by assigning Expression (2) to Expression (1).

$$Qa = a_0 \cdot CA_t \cdot \sigma \quad (3)$$

Here, note that the speed of sound $a_0$ in the atmosphere is represented by the following Expression (4) by using a gas constant R and the intake air temperature To.

$$a_0 = \sqrt{\kappa R T_0} \quad (4)$$

In addition, upon transformation of Expression (3), the effective opening area CAt represented by the product of the flow coefficient C and the opening area At of the throttle valve 4 can be calculated by the following Expression (5) when the target amount of intake air Qa* required to achieve the target torque, the speed of sound $a_0$ in the atmosphere, and the dimensionless flow rate σ are provided.

$$CA_t = \frac{Qa}{a_0 \cdot \sigma} \quad (5)$$

Accordingly, the target effective opening area calculation means 11 in the ECU 9 calculates the target effective opening area CAt* to achieve the target amount of intake air Qa* by using Expression (5) based on the target amount of intake air Qa*, the speed of sound $a_0$ in the atmosphere, and the dimensionless flow rate σ.

Thus, based on the volumetric flow formula of the throttle type flow meter represented by Expression (1), the target effective opening area CAt* can be calculated. Accordingly, even if the operating state of the engine 1 is changed resulting from a change of the environmental condition, the introduction of EGR (opening of the EGR valve 8), etc, the target effective opening area CAt* to adequately achieve the target amount of intake air Qa* can be calculated.

The calculation of the speed of sound $a_0$ in the atmosphere, which is required for the calculation of the target effective opening area CAt*, by using Expression (4) above in the ECU 9 makes a calculation load enormous, and therefore, is not practical. Thus, in order to keep the calculation load in the ECU 9 small, it is contemplated that the sound speed calculation means 12 calculates a theoretical value of the speed of sound $a_0$ in the atmosphere in advance, and stores the calculated theoretical value as map data with respect to the intake air temperature To. By using such map data, the sound speed calculation means 12 can use the intake air temperature To calculate the speed of sound $a_0$ in the atmosphere prior to the calculation processing in the target effective opening area calculation means 11.

Similarly, the calculation of the dimensionless flow rate σ required for the calculation of the target effective opening area CAt*, by using Expression (2) above in the ECU 9 also makes a calculation load enormous, and therefore, is not practical. Thus, in order to keep the calculation load in the ECU 9 small, it is contemplated that the dimensionless flow rate calculation means 14 calculates a theoretical value of the dimensionless flow rate σ in advance, and stores the calculated theoretical value as map data with respect to the pressure ratio of the intake manifold pressure Pe to the atmospheric pressure Po. By using such map data, the dimensionless flow rate calculation means 14 can use the pressure ratio Pe/Po of the intake manifold pressure Pe to the atmospheric pressure Po calculated in the pressure ratio calculation means 13 to calculate the dimensionless flow rate σ prior to the calculation processing in the target effective opening area calculation means 11.

However, it is generally known that when the pressure ratio Pe/Po is equal to or less than a sixth predetermined value (about 0.528 in the case of air), the flow rate of air passing through the throttle valve 4 is saturated (so-called choking). In addition, it is also known that when such a choking occurs, the dimensionless flow rate σ calculated by Expression (2) becomes a constant value.

Accordingly, the pressure ratio calculation means 13 includes pressure ratio fixing means (not shown) which can deal with the occurrence of choking by fixedly setting the pressure ratio Pe/Po to the sixth predetermined value when the pressure ratio Pe/Po is equal to or less than the sixth predetermined value.

Note that instead of fixedly setting the pressure ratio Pe/Po to the sixth predetermined value in the pressure ratio calculation means 13, the map value of the dimensionless flow rate σ corresponding to the pressure ratio Pe/Po in the dimensionless flow rate calculation means 14 may be set to the same value as in the case of the sixth predetermined value, in a region in which the pressure ratio Pe/Po is equal to or less than the sixth predetermined value.

On the other hand, when the pressure ratio Pe/Po becomes equal to or larger than a certain value, the air flow sensor 2 and the intake manifold pressure sensor 7 are subjected to the influence of the pulsation of intake air, and hence there is a possibility that an error might occur in the measured value of the amount of intake air Qa with respect to the actual amount of intake air. Besides, there is also a possibility that the calculation of the dimensionless flow rate σ might be subjected to the great influence of a measurement error of the intake manifold pressure Pe due to the pulsation of intake air.

Accordingly, when the pressure ratio Pe/Po is equal to or larger than a second predetermined value, the pressure ratio fixing means (not shown) in the pressure ratio calculation means 13 suppresses the influence of the pulsation of intake air to thereby ensure the controllability of the throttle valve 4 by dealing with the pressure ratio Pe/Po as the second predetermined value.

Here, note that instead of fixedly setting the pressure ratio Pe/Po to the second predetermined value in the pressure ratio calculation means 13, the map value of the dimensionless flow rate σ corresponding to the pressure ratio Pe/Po in the dimensionless flow rate calculation means 14 may be set to the same value as in the case of the second predetermined value, in a region in which the pressure ratio Pe/Po is equal to or larger than the second predetermined value.

Next, the target opening calculation means 15 calculates the target opening TP* by using the target effective opening area CAt* calculated by the target effective opening area calculation means 11. At this time, the target opening calculation means 15 obtains in advance the relation between the measured value of the actual throttle opening TP and the effective opening area CAt calculated from the measured value of the amount of intake air Qa according to the above Expression (5), and stores the obtained relation as a two dimensional map in which the actual throttle opening TP and the effective opening area CAt corresponding to each other one by one.

Further, the target opening calculation means 15 can calculate the target opening TP* corresponding to the target effective opening area CAt* by using the two dimensional map. As a result, the two dimensional map of the actual throttle opening TP and the effective opening area CAt can be easily prepared, thus making it possible to reduce the man-hours for setting to a substantial extent.

Next, the throttle opening control means in the processing unit 9*b* controls the throttle valve 4 so as to attain the target opening TP* calculated by the target opening calculation means 15. In this case, the throttle opening control means calculates the throttle opening learning value so as to decrease an error between the target amount of intake air Qa* and the actual amount of intake air Qa resulting from the variations of the throttle body and the various kinds of sensors 31, various estimation errors, etc.

Figure 4:
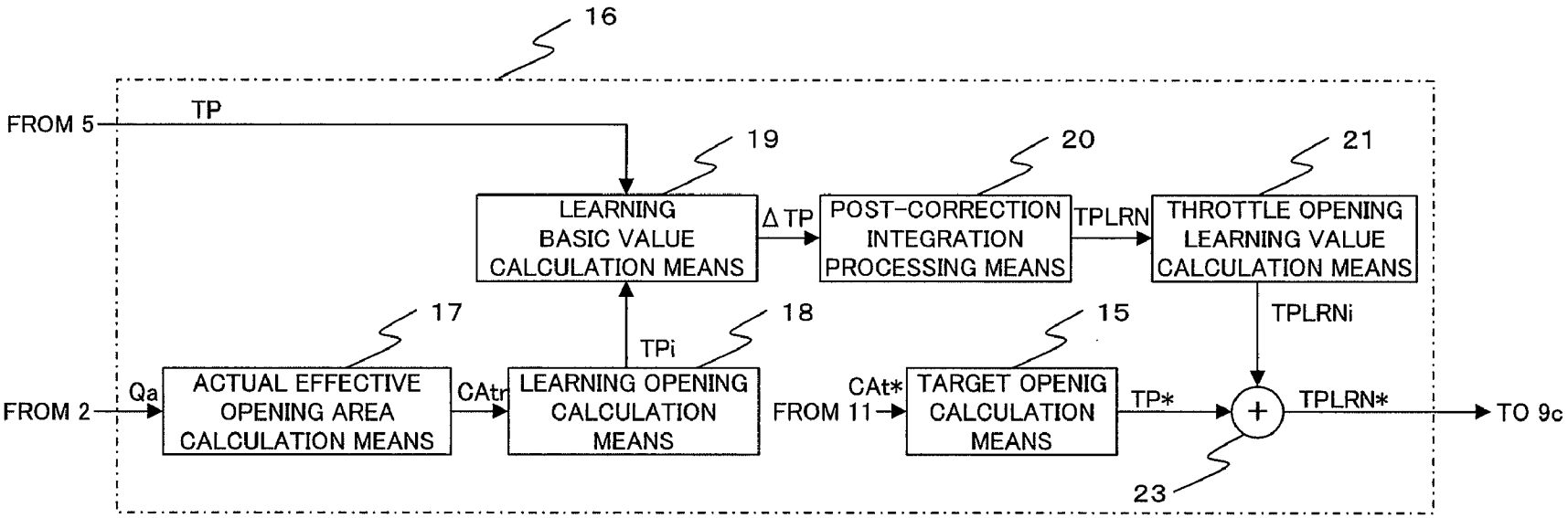
FIG. 4 is a functional block diagram schematically illustrating a peripheral configuration of throttle opening learning value calculation means in throttle opening control means in the first embodiment of the present invention.

Next, detailed description is made of calculation processing for a throttle opening learning value TPLRN according to the first embodiment of the present invention while referring to FIG. 4. FIG. 4 is a functional block diagram schematically illustrating a peripheral configuration of throttle opening learning value calculation processing means 21 in the throttle opening control means 16 according to the first embodiment of the present invention.

In FIG. 4, the throttle opening control means 16 in the processing unit 9*b* of the ECU 9 is provided with actual effective opening area calculation means 17, learning throttle opening calculation means 18 (hereinafter, referred to as "learning opening calculation means 18"), the learning basic value calculation means 19 connected to the throttle position sensor 5, post-correction integration processing means 20 that integrates a learning basic value ΔTP, the throttle opening learning value calculation means 21, the target opening calculation means 15, and the learning corrected target throttle opening calculation means 23 (hereinafter, referred to as "learning corrected target opening calculation means 23").

Note that the configuration upstream of the target opening calculation means 15 is similar to that in the above-mentioned FIG. 3, and hence is omitted in FIG. 4.

The actual effective opening area calculation means 17 takes in the actual amount of intake air Qa when the throttle valve 4 is controlled to the target opening TP* through the air flow sensor 2 to calculate an actual effective opening area CAtr of the throttle valve 4 according to the throttle opening control means 16 based on the actual amount of intake air Qa.

At this time, the actual effective opening area calculation means 17 calculates the actual effective opening area CAtr of the throttle opening control means 16, as shown by the above-mentioned Expression (5), by applying the amount of intake air Qa, the atmospheric pressure Po, the intake manifold pressure Pe, and the intake air temperature To the flow rate formula of a so-called throttle type flow meter, and inputs the result to the learning opening calculation means 18.

The learning throttle opening calculation means 18 uses a correlation map relation between the actual throttle opening TP and the effective opening area CAt that are suited to each other in advance (hereinafter, referred to as "CAt-TP map") to calculate a learning throttle opening (hereinafter, referred to as "learning opening") TPi corresponding to the sum of the learning map throttle opening calculated from the actual effective opening area CAtr, the real-time learning value TPR, and the long time learning value TPLr corresponding to the actual effective opening area CAtr, and inputs the calculated learning opening to the learning basic value calculation means 19.

The learning basic value calculation means 19 calculates the deviation ΔTP (=TP−TPi) between the actual throttle opening TP detected by the throttle position sensor 5 and the learning opening TPi as the learning basic value, and inputs the calculated deviation to the post-correction integration processing means 20. Here, the same timing as that for calculating the learning opening TPi is used for the actual throttle opening TP. In place of the actual throttle opening TP, the target opening TP* may also be used.

The post-correction integration processing means 20 integrates the value obtained by multiplying the learning basic value ΔTP by a correction factor Kc ($0 \leqq Kc \leqq 1$) in a sequential manner (or by applying filtering processing to the learning basic value ΔTP), and inputs a value, which is obtained by removing an instantaneous variation from the learning basic value ΔTP, to the throttle opening learning value calculation means 21 as the throttle opening learning value TPLRN.

Figure 5:
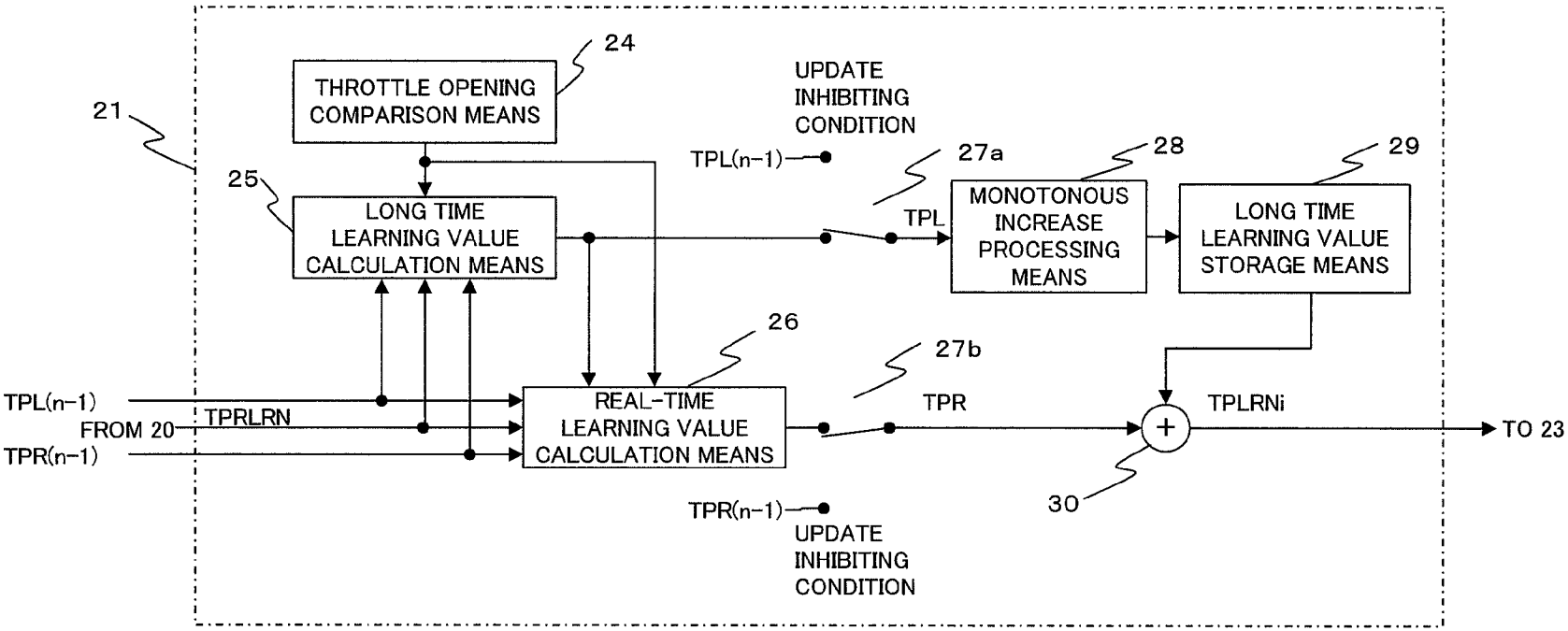
FIG. 5 is a functional block diagram illustrating a configuration in the throttle opening learning value calculation means in the first embodiment of the present invention.

Next, the throttle opening learning value TPLRN obtained by the post-correction integration processing means 20 is distributed to the real-time learning value TPR and the long time learning value TPL in the throttle opening learning value calculation means 21 as shown in FIG. 5 referred to below. Here, the real-time learning value TPR is a learning value used as feedback control. The long time learning value TPL is a learning value stored for each learning region corresponding to CAt axis points (abscissa axis in FIG. 6 or FIG. 7 referred to below) of the CAt-TP map.

As a result, the sum of a value on the CAt-TP map and the long time learning value TPL can be brought close to the actual CAt-TP relation. In addition, an instantaneous error can be absorbed by the feedback control together with the use of the real-time learning value TPR.

Next, an operation of the throttle opening learning value calculation means 21 is described referring to FIG. 5. FIG. 5 is a functional block diagram illustrating a configuration in the throttle opening learning value calculation means 21 in the first embodiment of the present invention.

The throttle opening learning value calculation means 21 shown in FIG. 5 includes throttle opening comparison means 24, long time learning value calculation means 25, real-time learning value calculation means 26, switching means 27*a* and 27*b*, monotonous increase processing means 28, long time learning value storage means 29, and correction throttle opening learning value calculation means 30 (hereinafter, referred to as "correction opening learning value calculation means 30").

The long time learning value calculation means 25 and the real-time learning value calculation means 26 are respectively connected to the post-correction integration processing means 20 and the throttle opening comparison means 24. The monotonous increase processing means 28 is connected to the long time learning value calculation means 25 through the switching means 27*a*.

The long time learning value storage means 29 is connected to the monotonous increase processing means 28. Further, the correction opening learning value calculation means 30 is connected to the real-time learning value calculation means 26 through the switching means 27*b* and also to the long time learning value storage means 29.

The throttle opening learning value TPLRN obtained from the post-correction integration processing means 20 is distributed to at least one of a real-time learning value TPR updated in real time and a long time learning value TPL corresponding to each learning region according to effective opening area axis points (CAt axis points) of the CAt-TP map.

First, the throttle opening comparison means 24 compares values obtained by adding the long time learning value TPL respectively to TP map values at two CAt axis points of the CAt-TP map, between which lies the actual effective opening area CAtr, and the actual throttle opening TP for their magnitude relation to decide the real-time learning value TPR and the long time learning value TPL to be updated.

For easy understanding of the following description, the upper CAt axis point of the two CAt axis points is referred to as CAt[m], whereas the lower CAt axis point is referred to as CAt[m−1]. The sum of the TP map value at the upper CAt axis point CAt[m] and the long time learning value TPL is referred to as TP[m], whereas the sum of the CAt-TP map value at the lower CAt axis point CAt[m−1] and the long time learning value TPL is referred to as TP[m−1].

Based on the contents decided in the throttle opening comparison means 24, the long time learning value calculation means 25 calculates the long time learning value TPL, whereas the real-time learning value calculation means 26 calculates the real-time learning value TPR. As a result, over-learning for the learning update can be prevented.

When a predetermined update inhibiting condition (described below) holds, the switching means 27*a* causes the last long time learning value TPL(n−1) to be input as the long time learning value TPL to the monotonous increase processing means 28 to inhibit the update of the long time learning value TPL.

On the other hand, when the update inhibiting condition of the long time learning value TPL does not hold (specifically, the update is not inhibited), the switching means 27*a* causes the long time learning value TPL calculated by the long time learning value calculation means 25 to be input as the final long time learning value TPL of the learning region according to the CAt axis points of the CAt-TP map to the monotonous increase processing means 28.

Similarly, when the predetermined update inhibiting condition (described below) holds, the switching means 27*b* causes the last real-time learning value TPR(n−1) to be input as the real-time learning value TPR to the correction opening learning value calculation means 30 to inhibit the update of the real-time learning value TPR.

On the other hand, when the update inhibiting condition of the real-time learning value TPR does not hold (specifically, the update is not inhibited), the switching means 27*b* causes the real-time learning value TPR calculated by the real-time learning value calculation means 26 to be input as the final real-time learning value TPR to the correction opening learning value calculation means 30.

As a specific example of the update inhibiting condition in the switching means 27*a* and 27*b*, the updates of the real-time learning value TPR and the long time learning value TPL may be inhibited when a deviation between the target opening TP* and the actual throttle opening TP is equal to or larger than a first predetermined value.

In addition, when the pressure ratio Pe/Po of the intake manifold pressure Pe (intake pipe internal pressure) to the atmospheric pressure Po indicates the second predetermined value or larger, the updates of the real-time learning value TPR and the long time learning value TPL may be inhibited.

Further, in at least one of the case where a deviation between the learning opening TPi and the actual throttle opening TP or the target opening TP* becomes equal to or less than a third predetermined value, the case where a deviation rate of the target amount of intake air Qa* to the amount of intake air Qa becomes equal to or less than a fourth predetermined value, and the case where a deviation between the target effective opening area CAt* and the actual effective opening area CAtr becomes equal to or less than a fifth predetermined value, the updates of the real-time learning value TPR and the long time learning value TPL may be inhibited.

The monotonous increase processing means 28 limits the long time learning value TPL in such a manner that the CAt-TP map and the actual CAt-TP relation (relation between the effective opening area CAt and the actual throttle opening TP of the throttle opening control means 16) after corrected by addition thereto of the long time learning value TPL become monotonously increasing.

The long time learning value storage means 29 stores the long time learning value TPL through the monotonous increase processing means 28. Further, the correction opening learning value calculation means 30 is in the form of an adding means for serving to add the real-time learning value TPR and the long time learning value TPL to each other, and inputs the result of the addition to the learning corrected target opening calculation means 23 as a correction throttle opening learning value TPLRNi (hereinafter, referred to as "correction opening learning value TPLRNi").

The learning corrected target opening calculation means 23 adds the correction opening learning value TPLRNi and the target opening TP* calculated by the target opening calculation means 15 to calculate a learning corrected target throttle opening TPLRN* (hereinafter, referred to as "learning corrected target opening TPLRN*").

As described above, the throttle opening control means 16 calculates the throttle opening learning value TPLRN based on the learning basic value ΔTP (deviation between the actual throttle opening TP and the learning opening TPi). Further, the throttle opening control means 16 uses the learning corrected target opening TPLRN* obtained by correcting the target opening TP* with the correction opening learning value TPLRNi to control the actual throttle opening TP. As a result, an error between the target amount of intake air Qa* and the amount of intake air Qa can be reduced.

Therefore, for the calculation of the actual throttle opening TP for obtaining the target amount of intake air Qa*, the relation between the effective opening area CAt and the actual throttle opening TP can be learned and corrected to adequately achieve the target amount of intake air Qa* against variations between the throttle bodies, various sensors and the like, and errors in various estimation calculations.

The long time learning value storage means 29 in the throttle opening control means 16 functions as a backup memory. That is, when the engine 1 is stopped or when the power supply for the control apparatus for an internal combustion engine is turned off, the real-time learning value TPR is reset, and the long time learning value TPL is held in the long time learning value storage means 29 (backup memory).

Figure 6:
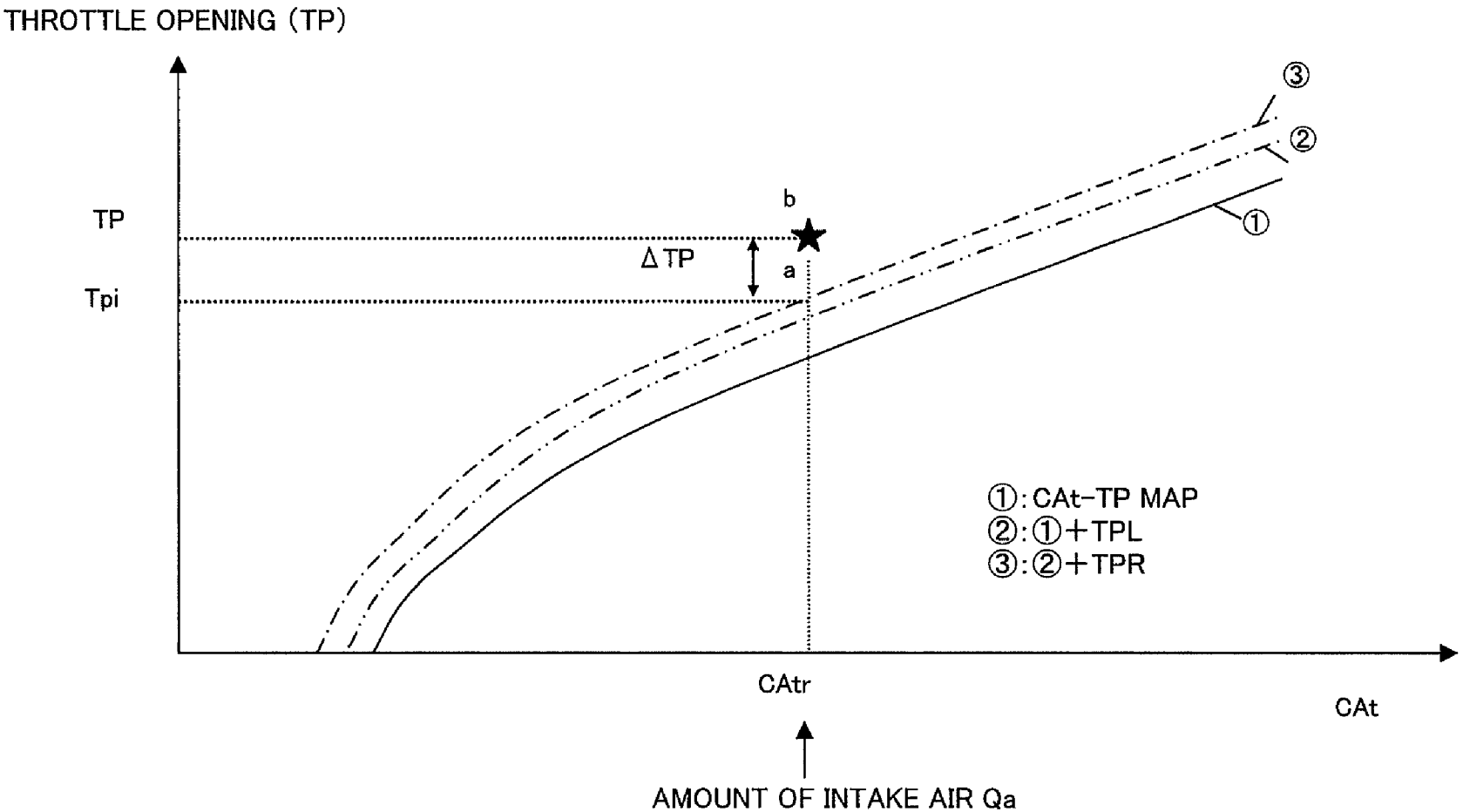
FIG. 6 is an explanatory view schematically illustrating calculation processing of a throttle opening learning value TPLRN in the first embodiment of the present invention.
Figure 7:
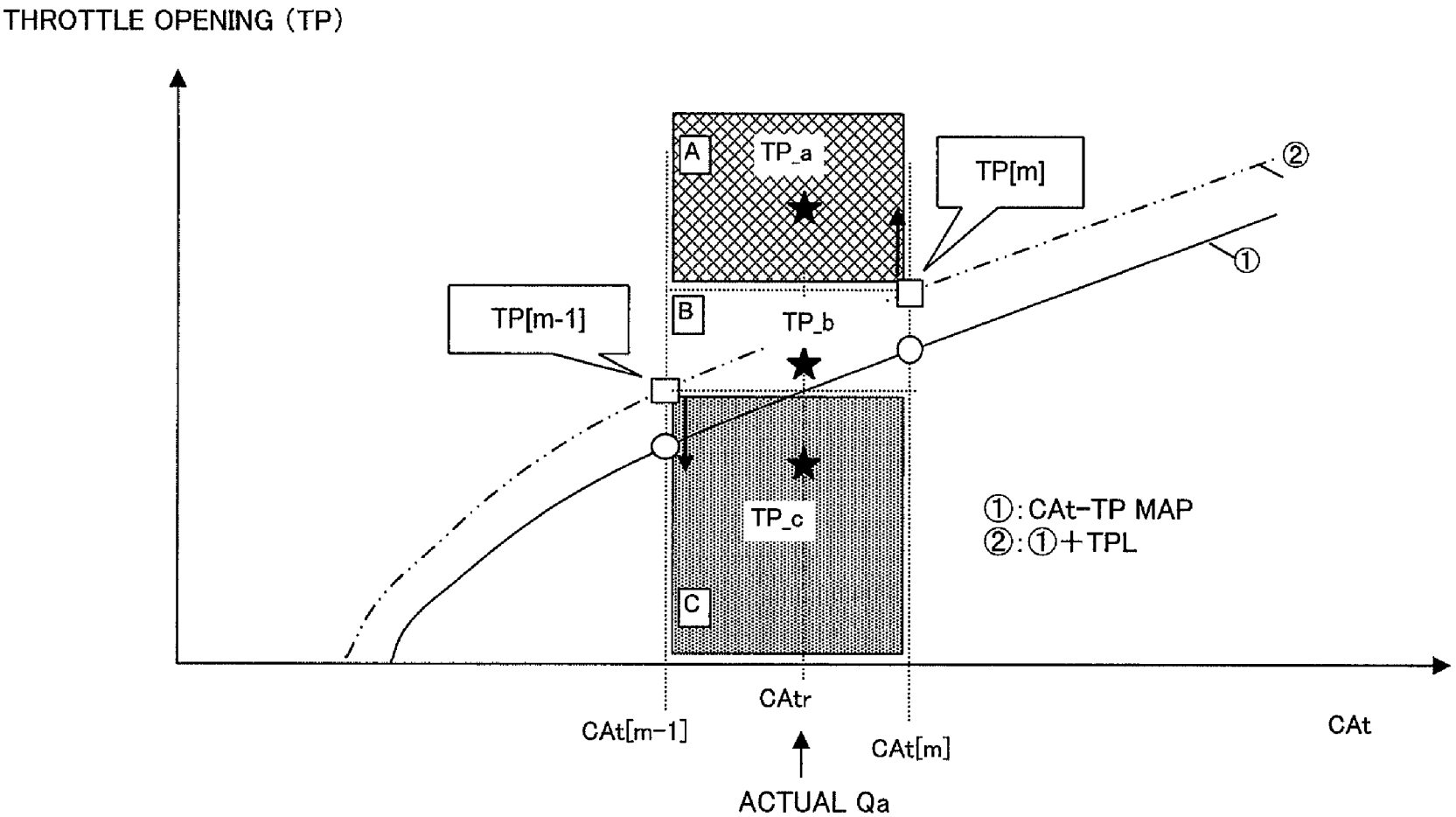
FIG. 7 is an explanatory view schematically illustrating storage processing of a long time learning value in the first embodiment of the present invention.
Figure 8:
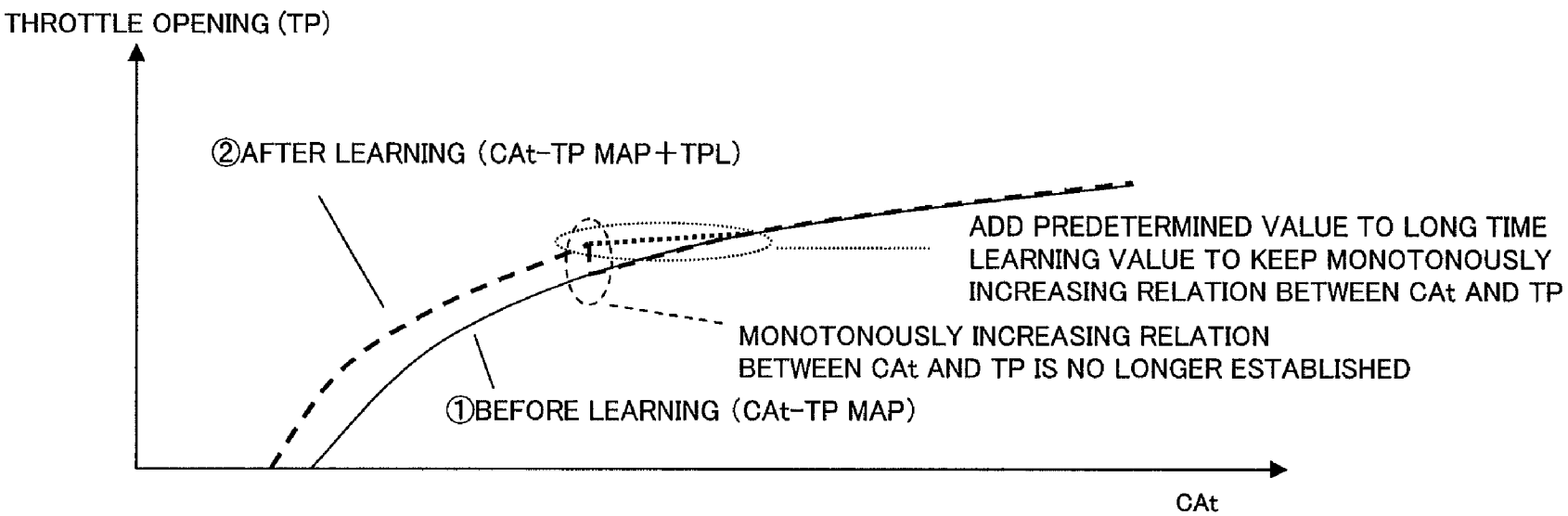
FIG. 8 is an explanatory view schematically illustrating monotonous increase processing in the first embodiment of the present invention.

Next, the calculation processing of the long time learning value TPL for each learning region is specifically described referring to FIGS. 6 to 8. FIG. 6 is an explanatory view schematically illustrating the calculation processing of the throttle opening learning value TPLRN in the first embodiment of the present invention. FIG. 7 is an explanatory view schematically illustrating storage processing of the long time learning value in the first embodiment of the present invention. Further, FIG. 8 is an explanatory view schematically illustrating monotonous increase processing in the first embodiment of the present invention.

As described above, the post-correction integration processing means 20 calculates the difference ΔTP between a point a and a point b (specifically, throttle opening deviation between the actual throttle opening TP and the learning opening TPi) as the learning basic value (see FIG. 6).

Next, as described above, the throttle opening learning value calculation means 21 compares the values obtained by adding the long time learning value TPL respectively to the TP map values at the two CAt axis points of the CAt-TP map, between which lies the actual effective opening area CAtr, and the actual throttle opening TP, for their magnitude relation to calculate the real-time learning value TPR and the long time learning value TPL (see FIG. 7).

As the magnitude relation, three patterns exist and the processing for each pattern is as follows. As the first magnitude relation, when the actual throttle opening TP is equal to or larger than TP[m] (specifically, the actual throttle opening TP is present in a region A of FIG. 7), the long time learning value TPL is calculated in the long time learning value calculation means 25 by subtracting a predetermined value A from the sum of the last long time learning value TPL[m](n−1) corresponding to CAt[m], the throttle opening learning value TPLRN, and the last real-time learning value TPR(n−1) as expressed by the following Expression (6). Here, the predetermined value A is the maximum value of TPR on the CAt axis point, and can be arbitrarily set. However, TP[m] does not exceed the actual throttle opening TP.

$$TPL[m]=TPL[m](n-1)+TPLRN+TPR(n-1)-\text{predetermined value } A \quad (6)$$

On the other hand, in the real-time learning value calculation means 26, the real-time learning value TPR is calculated by subtracting the long time learning value TPLr with the actual effective opening area CAtr from the sum of the last real-time learning value TPR(n−1) and the long time learning value TPLr(n−1) with the last actual effective opening area CAtr as expressed by the following Expression (7).

$$TPR=TPLRN+TPR(n-1)+TRPLr(n-1)-TPLr \quad (7)$$

As the second magnitude relation, when the actual throttle opening TP is smaller than TP[m] and larger than TP[m−1] (specifically, the actual throttle opening TP is present in a region B of FIG. 7), the real-time learning value TPR is calculated in the real-time learning value calculation means 26 by adding the throttle opening learning value TPLRN to the last real-time learning value TPR(n−1) as expressed by the following Expression (8). The last value is maintained as the long time learning value TPL in the region B.

$$TPR=TPLRN+TPR(n-1) \quad (8)$$

As the third magnitude relation, when the actual throttle opening TP is equal to or smaller than TP[m−1] (specifically, the actual throttle opening TP is present in a region C of FIG. 7), the long time learning value TPL is calculated in the long time learning value calculation means 25 by subtracting a predetermined value B from the sum of the last long time learning value TPL[m−1](n−1) corresponding to CAt[m−1], the throttle opening learning value TPLRN, and the last real-time learning value TPR(n−1) as expressed by the following Expression (9). Here, the predetermined value B is the minimum value of TPR on the CAt axis point, and can be arbitrarily set. However, TP[m−1] does not become less than the actual throttle opening TP.

$$TPL[m-1]=TPL[m-1](n-1)+TPLRN+TPR(n-1)-\text{predetermined value } B \quad (9)$$

On the other hand, in the real-time learning value calculation means 26, the real-time learning value TPR is calculated by subtracting the long time learning value TPLr with the actual effective opening area CAtr from the sum of the throttle opening learning value TPLRN, the last real-time learning value TPR(n−1), and the long time learning value TPLr(n−1) with the last actual effective opening area CAtr as expressed by the following Expression (10).

$$TPR=TPLRN+TPR(n-1)+TPLr(n-1)-TPLr \quad (10)$$

As described above, the throttle opening learning value calculation means 21 compares the actual throttle opening TP and the sum of the TP map value at each of the two CAt axis points of the CAt-TP map, between which lies the actual effective opening area CAtr, for their magnitude relation to appropriately discriminate the learning region for which the long time learning value is to be updated. As a result, the long time learning value can be updated by a single axis point.

Moreover, for updating the long time learning value, the sum of the long time learning value to be updated and the TP map value is prevented from exceeding or being less than the actual throttle opening TP to prevent the overlearning. As a result, the throttle learning value can be restrained from greatly fluctuating.

In general, the actual throttle opening TP and the amount of intake air Qa are in a monotonously increasing relation. Therefore, the effective opening area CAt and the actual throttle opening TP are also required to be in a monotonously increasing relation. However, when learning is locally performed, as indicated by a broken line and a broken line frame in FIG. 8, it may happen that the sum of the value of the CAt-TP map (see a solid line) and the long time learning value (see the broken line) does not monotonously increase.

In this case, for example, the learning corrected target opening TPLRN* decreases even though the target amount of intake air Qa* increases. Therefore, there arise problems such as reduction in output power of the engine 1 and mislearning of the throttle opening learning value TPLRN.

Figure 9:
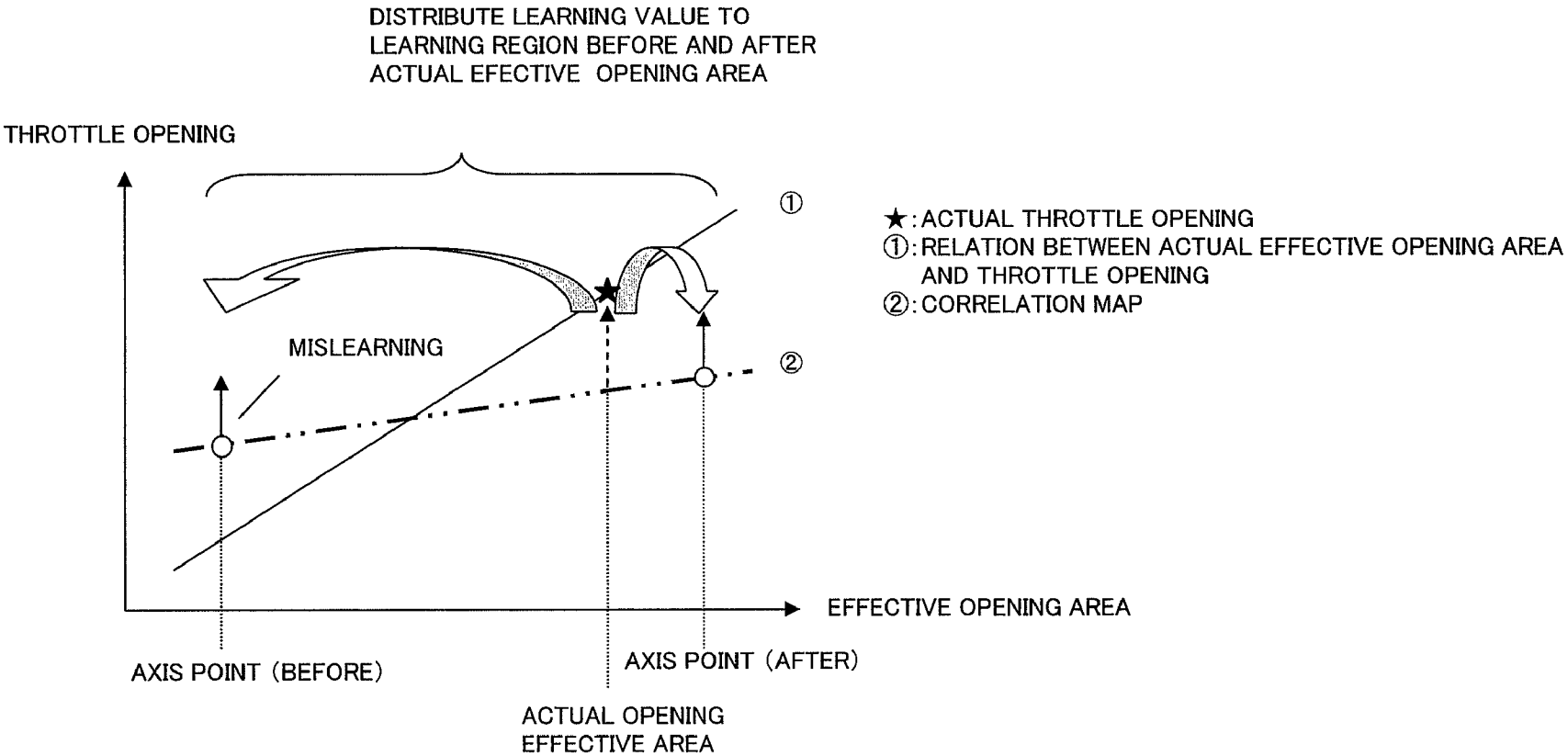
FIG. 9 is an explanatory view of the throttle learning value calculated in the related art.

Accordingly, the monotonous increase processing means 28 performs the processing of adding a predetermined value to the long time learning value TPL thereby to limit the long time learning value TPL in such a manner that the sum of the value of the CAt-TP map (solid line) and the long time learning value TPL (see a dotted line) becomes monotonously increasing, as indicated by a dotted line and a dotted line frame in FIG. 9. As a result, the mislearning and malfunction of the throttle opening learning value TPLRN can be prevented.

Hereinafter, specific reference is made to the monotonous increase processing according to the monotonous increase processing means 28. First, by using a CAt axis point number n, the long time learning value currently being learned is set as TPL(n), and the range that can be taken by the CAt axis point number n currently being learned is set to "1≦n≦CAt axis point number".

Here, the long time learning value TPL after the monotonously increasing correction can be calculated by repeating the calculation of the following Expression (11) for a long time learning value TPL (m+1+i) that is in a region in which the CAt axis point number n thereof is larger than a predetermined value m.

$$TPL(m+1+i)=\max\{\text{CAt map value}(m+i)+TPL(m+i)+\text{predetermined value, CAt map value}(m+1+i)+TPL(M+1+i)\}-\text{CAt map value}(m+1+i) \quad (11)$$

In the above Expression (11), a variable i sequentially increases from "0" up to "CAt axis point number-(m+1)" at the time of repeating the calculation.

Further, the long time learning value TPL after the monotonously increasing correction can be calculated by repeating the calculation of the following Expression (12) for a long time learning value TPL (m−1−i) that is in a region where the CAt axis number n thereof is less than the predetermined value m.

$$TPL(m-1-j)=\min\{\text{CAt map value}(m-j)+TPL(m-j)-\text{predetermined value, CAt map value}(n-1-j)+TPL(m-1-j)\}-\text{CAt map value}(m-1-j) \quad (12)$$

In the above Expression (12), a variable j sequentially increases from "0" up to "m−2" at the time of repeating the calculation. After execution of the calculations of the above-mentioned Expressions (11) and (12), the long time learning value storage means 29 stores a final long time learning value TPL in each learning region.

As shown in FIG. 5, the correction opening learning value calculation means 30 adds the real-time learning value TPR and the long time learning value TPL corresponding to an operating range to each other thereby to calculate a correction opening learning value TPLRNi, and inputs it to the learning corrected target opening calculation means 23. Accordingly, the learning corrected target opening calculation means 23 calculates the learning corrected target opening TPLRN* (=TPLRNi+TP*) by using the correction opening learning value TPLRNi.

As described above, the calculation of the throttle opening learning value TPLRN is performed, and at the same time, the calculation and storing of the long time learning value TPL based on the throttle opening learning value TPLRN are also carried out. However, such learning processing cannot be performed in all the operating ranges, and hence learning inhibiting processing is needed. Hereinafter, specific reference is made to a learning inhibiting condition according to the first embodiment of the present invention.

When the target opening TP* is suddenly changed during the transient operation or the like, a certain time will be needed until the time when the amount of intake air Qa responds, due to a response delay until the flow speed near the air flow sensor 2 is changed due to the change of the throttle opening, a response delay of the air flow sensor 2 itself, and the like.

Therefore, when the deviation between the target opening TP* and the actual throttle opening TP becomes equal to or larger than the first predetermined value, the switching means 27*a* and 27*b* inhibit the updates of the real-time learning value TPR and the long time learning value TPL. As a result, the mislearning of the long time learning value TPL due to a response delay of the amount of intake air Qa or the like can be prevented.

Moreover, the air flow sensor 2 is subjected to the influence of the pulsation of intake air when the pressure ratio Pe/Po of the intake manifold pressure Pe to the atmospheric pressure Po increases to a certain extent. Therefore, an error may occur between an actual amount of intake air and a measured amount of intake air. In such an operating range, the throttle opening learning value TPLRN cannot be calculated accurately.

Therefore, when the pressure ratio Pe/Po indicates a value equal to or larger than the first predetermined value described above, the switching means 27*a* and 27*b* select the last real-time learning value TPR(n−1) and the last long time learning value TPL(n−1) to inhibit the updates of the real-time learning value TPR and the long time learning value TPL. As a result, the mislearning of the actual throttle opening TP due to the influence of the pulsation of intake air can be prevented.

In addition, in any one of the case where the deviation between the learning opening TPi and the actual throttle opening TP or the target opening TP* becomes equal to or less than the third predetermined value, the case where the deviation rate of the target amount of intake air Qa* to the amount of intake air Qa becomes equal to or less than the fourth predetermined value, and the case where the deviation between the target effective opening area CAt* and the actual effective opening area CAtr becomes equal to or less than the fifth predetermined value, the updates of the real-time learning value TPR and the long time learning value TPL are inhibited. As a result, each of the above-mentioned conditions functions as a dead band of the throttle learning. Accordingly, the fluctuation of the throttle opening learning value (specifically, fluctuation of the throttle opening) can be prevented when the throttle learning value converges.

What is claimed is:

1. A control apparatus for an internal combustion engine, comprising:

a throttle valve that is arranged in an intake passage of the internal combustion engine;

throttle opening control means for controlling a throttle opening of the throttle valve to change an effective opening area of the intake passage to variably control an amount of intake air to the internal combustion engine;

means for detecting an actual throttle opening of the throttle valve;

operating state detection means for detecting an operating state of the internal combustion engine, the operating state detection means including intake air amount detection means for detecting the amount of intake air to the internal combustion engine, atmospheric pressure detection means for detecting a pressure at an atmospheric side of the throttle valve as an atmospheric pressure, intake pipe internal pressure detection means for detecting a pressure at an internal combustion engine side of the throttle valve as an intake pipe internal pressure, and intake air temperature detection means for detecting an intake air temperature at the atmospheric side of the throttle valve;

target intake air amount calculation means for calculating a target amount of intake air based on the operating state of the internal combustion engine;

target effective opening area calculation means for applying the target amount of intake air, the atmospheric pressure, the intake pipe internal pressure, and the intake air temperature to a flow rate formula for a throttle type flow meter to calculate a target effective opening area of the throttle opening control means;

target throttle opening calculation means for using a correlation map between the effective opening area of the throttle opening control means and the throttle opening of the throttle opening control means, which are suited to each other in advance, to calculate a target throttle opening from the target effective opening area;

actual effective opening area calculation means for applying the amount of intake air, the atmospheric pressure, the intake pipe internal pressure, and the intake air temperature to the flow rate formula for the throttle type flow meter to calculate an actual effective opening area of the throttle opening control means; and learning throttle opening calculation means for using the correlation map to calculate a learning throttle opening from the actual effective opening area, wherein the throttle opening control means includes throttle opening learning value calculation means for calculating a throttle opening learning value based on a deviation between one of the actual throttle opening and the target throttle opening, and the learning throttle opening, and controls the throttle opening by a learning corrected target throttle opening obtained by correcting the target throttle opening with the throttle opening learning value, and wherein the throttle opening learning value calculation means calculates the throttle opening learning value as a value composed of a real-time learning value used for a feedback control and updated in real time and a long time learning value corresponding to each learning region according to an effective opening area axis point of the correlation map, and updates and stores the real-time learning value and the long time learning value, to bring the sum of a value of a throttle opening corresponding to the target effective opening area on the correlation map and the throttle opening learning value close to the actual throttle opening corresponding to the target effective opening area, based on a magnitude relation between values respectively obtained by adding the long time learning value to throttle openings respectively indicated by two effective opening area axis points of the correlation map, between which lies the actual effective opening area, and the actual throttle opening when the throttle opening learning value is to be calculated.

2. A control apparatus for an internal combustion engine according to claim 1, wherein the throttle opening learning value calculation means prevents a sum of a throttle opening indicated by an upper axis point of the two effective opening area axis points of the correlation map, between which lies the actual effective opening area, and the long time learning value from exceeding the actual throttle opening when the throttle learning value corresponding to the upper axis point is to be updated, and prevents a sum of a throttle opening indicated by a lower axis point and the long time learning value from being less than the actual throttle opening when the throttle learning value corresponding to the lower axis point is to be updated.

3. A control apparatus for an internal combustion engine according to claim 1, wherein the throttle opening learning value calculation means limits the long time learning value to cause a sum of the throttle opening indicated by the correlation map and the long time learning value to monotonously increase with respect to the effective opening area.

4. A control apparatus for an internal combustion engine according to claim 1, wherein the throttle opening learning value calculation means inhibits updates of the real-time learning value and the long time learning value when a deviation between the target throttle opening and the actual throttle opening becomes equal to or larger than a first predetermined value.

5. A control apparatus for an internal combustion engine according to claim 1, wherein the throttle opening learning value calculation means inhibits updates of the real-time learning value and the long time learning value when a pressure ratio of the intake pipe internal pressure to the atmospheric pressure exhibits a value equal to or larger than a second predetermined value.

6. A control apparatus for an internal combustion engine according to claim 1, wherein the throttle opening learning value calculation means inhibits updates of the real-time learning value and the long time learning value when at least one of a condition where the deviation between the learning throttle opening and one of the actual throttle opening and the target throttle opening becomes equal to or less than a third predetermined value, a condition where a deviation rate of the target flow rate of intake air to the actual flow rate of intake air becomes equal to or less than a fourth predetermined value, and a condition where a deviation between the target effective opening area and the actual effective opening area becomes equal to or less than a fifth predetermined value holds.

* * * * *